US008250871B2

(12) United States Patent
Kwon

(10) Patent No.: US 8,250,871 B2
(45) Date of Patent: Aug. 28, 2012

(54) REFRIGERATOR

(75) Inventor: Eui-Hyeok Kwon, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 658 days.

(21) Appl. No.: 12/518,777

(22) PCT Filed: Dec. 14, 2007

(86) PCT No.: PCT/KR2007/006547

§ 371 (c)(1),
(2), (4) Date: Jun. 11, 2009

(87) PCT Pub. No.: WO2008/072931

PCT Pub. Date: Jun. 19, 2008

(65) Prior Publication Data

US 2010/0024466 A1 Feb. 4, 2010

(30) Foreign Application Priority Data

Dec. 15, 2006 (KR) ..... 10-2006-0128314

(51) Int. Cl.
*F25B 49/00* (2006.01)
*F25D 11/00* (2006.01)

(52) U.S. Cl. ..... 62/125; 62/126; 62/440; 236/94

(58) Field of Classification Search ..... 62/125, 62/126, 127, 131, 440; 165/11.1; 236/94
See application file for complete search history.

(56) References Cited

U.S. PATENT DOCUMENTS

| | | | | |
|---|---|---|---|---|
| 6,483,695 | B1 * | 11/2002 | Hartstein | 361/679.09 |
| 7,673,464 | B2 * | 3/2010 | Bodin et al. | 62/127 |
| 2004/0035123 | A1 * | 2/2004 | Kim et al. | 62/127 |
| 2004/0117274 | A1 * | 6/2004 | Cenedese et al. | 705/28 |

FOREIGN PATENT DOCUMENTS

| | | | |
|---|---|---|---|
| KR | 10-1996-0014862 | A | 5/1996 |
| KR | 10-1999-0041832 | A | 6/1999 |
| KR | 10-2001-0092060 | A | 10/2001 |

* cited by examiner

*Primary Examiner* — Marc Norman
(74) *Attorney, Agent, or Firm* — Birch, Stewart, Kolasch & Birch, LLP

(57) ABSTRACT

A refrigerator includes a main body having a storage space provided with an opening, and doors by which the opening is opened or closed; a voice input section for inputting speech through an interior voice input unit installed at the inside of the main body and an exterior voice input unit installed at the outside of the main body; a control unit for controlling the state of the refrigerator by analyzing the inputted speech; and an output section displaying the state information of the refrigerator. Accordingly, since the state and the operation of the refrigerator are controlled by receiving a control command by speech input regardless of whether the door is opened or closed, it is capable of reducing a user's inconvenience due to manipulation of the control panel.

16 Claims, 7 Drawing Sheets

REFRIGERATOR

TECHNICAL FIELD

The present invention relates to a refrigerator, and more particularly, to a refrigerator which is capable of controlling its own state and operation by receiving external control commands by voice.

BACKGROUND ART

Generally, a refrigerator, an appliance for storing food at a low temperature, stores foods in a freezing manner or a chilling manner depending upon the kinds of foods.

Cool air for the refrigerator is generated by repetitive performance of a refrigeration cycle of compression, condensation, expansion, and evaporation of a refrigerant, and the cool air is supplied to the refrigerator continuously. The cool air supplied to respective chambers of the refrigerator thus is uniformly delivered throughout the interior of the refrigerator by convection to cool down the respective chambers to predetermined temperatures, so that food can be stored in the refrigerator at desired temperatures.

Such a refrigerator becomes larger and multifunctional according to users' various tastes and variation in eating patterns.

Hereafter, the configuration of a typical refrigerator will be described with reference to a drawing.

FIG. 1 is a front perspective view showing the configuration of a typical refrigerator.

Referring to FIG. 1, a main body 1 of the refrigerator is formed in an approximately rectangular shape, and has a storage space for storing food therein.

The storage space provided in the main body 1 is respectively formed of a freezing chamber 10 and a cooling chamber 20 by being partitioned into left and right sides. The freezing chamber 10 and the cooling chamber 20 are opened toward a front side of the main body 1. And, the opened front surfaces of the freezing chamber 10 and the cooling chamber 20 are selectively closed by a freezing chamber door 12 and a cooling chamber door 22 respectively mounted at the main body 1 to be rotatable rightwardly and leftwardly.

And, the front surfaces of the cooling chamber door 22 and the freezing chamber door 12 are respectively provided with a dispenser 14 and a refreshment center (e.g., so-called "home bar") 24, for the users' convenience. Further, a control panel 30 is installed at the cooling chamber door 22 or the freezing chamber door 12, for controlling the operation and state of the refrigerator. The control panel 30 is provided with control buttons 32 for controlling the operation and state of the refrigerator with and a display 31 presenting the control state. Thus, the user can control the operation and state of the refrigerator by manipulating the control buttons 32.

However, the related art refrigerator has problems as follows.

First, it is required that the control buttons be manipulated so as to control the operation and state of the refrigerator. Thus, a user must move toward the refrigerator for the manipulation thereof, which causes the user's inconvenience.

Second, a plurality of manipulation buttons are provided to adjust various functions of the refrigerator. Here, the user must manipulate the manipulation buttons by referring to a manual.

Third, recently, various kinds of items are stored in a refrigerator as the refrigerator becomes larger and multifunctional. However, the related art refrigerator lacks a function for detecting information about the stored items, such as the kind of the storage item, the position of the storage item, etc., and thus, the user must find out the storage item or the storage position of an item of the same kind by relying upon his/her own memory.

Accordingly, requirement for a function of detecting the kind of a storage item and the storage position of the item increases.

DISCLOSURE OF THE INVENTION

Technical Problem

Therefore, it is an object of the present invention to provide a refrigerator which is capable of receiving commands by a user's voice for controlling the operation and state thereof. Particularly, it is an object of the present invention to provide a refrigerator which is capable of receiving voice input when a door thereof is opened as well as closed.

Technical Solution

To achieve these objects, there is provided a refrigerator, comprising: a main body having a storage space provided with an opening, and a door by which the opening is opened or closed; a voice input section for receiving a user's voice input through an interior voice input unit installed at an inside of the main body and an exterior voice input unit installed at an outside of the main body; a control unit controlling a state of the refrigerator by analyzing the inputted speech; and an output section displaying the state information so as to enable checking of the state information from the outside of the refrigerator.

The voice input section is configured to be capable of receiving an external voice input regardless of whether the door is opened or closed.

The interior voice input unit is installed to be covered with by gasket provided at edge portions of a rear surface of the door when the door is closed.

The interior voice input unit is installed at one edge portion of the opening contacted by the door when the door is closed.

The exterior voice input unit is installed on the front surface of the door.

The interior voice input unit and the exterior voice input unit are operated or not according to whether the door is opened or closed, respectively.

The output section is implemented as a display terminal for visually outputting the state information.

MODES FOR CARRYING OUT THE PREFERRED EMBODIMENTS

Description will now be given in detail of the preferred embodiments of the present invention, examples of which are illustrated in the accompanying drawings.

Figure 1:
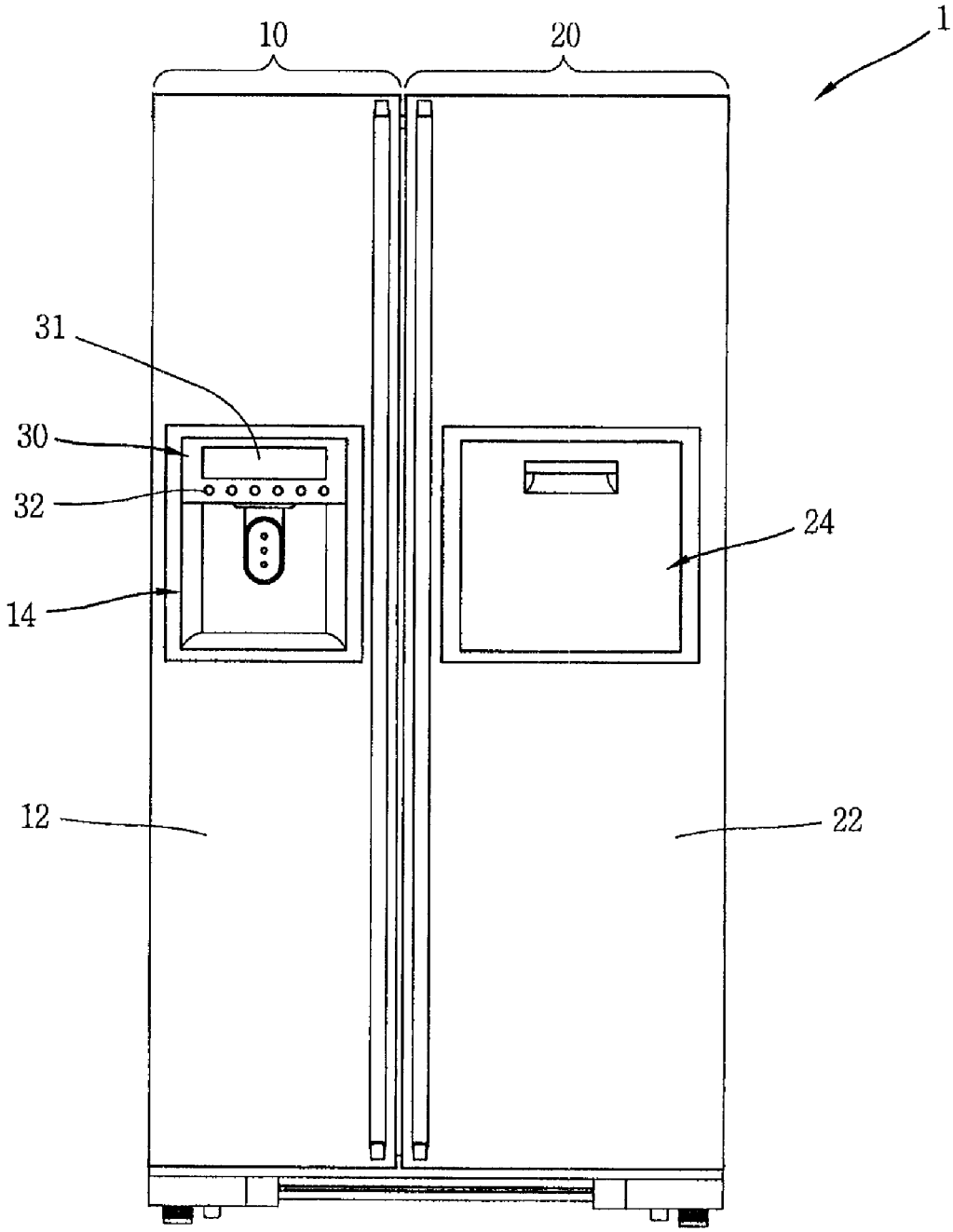
FIG. 1 is a front perspective view showing the configuration of a typical refrigerator.
Figure 2:
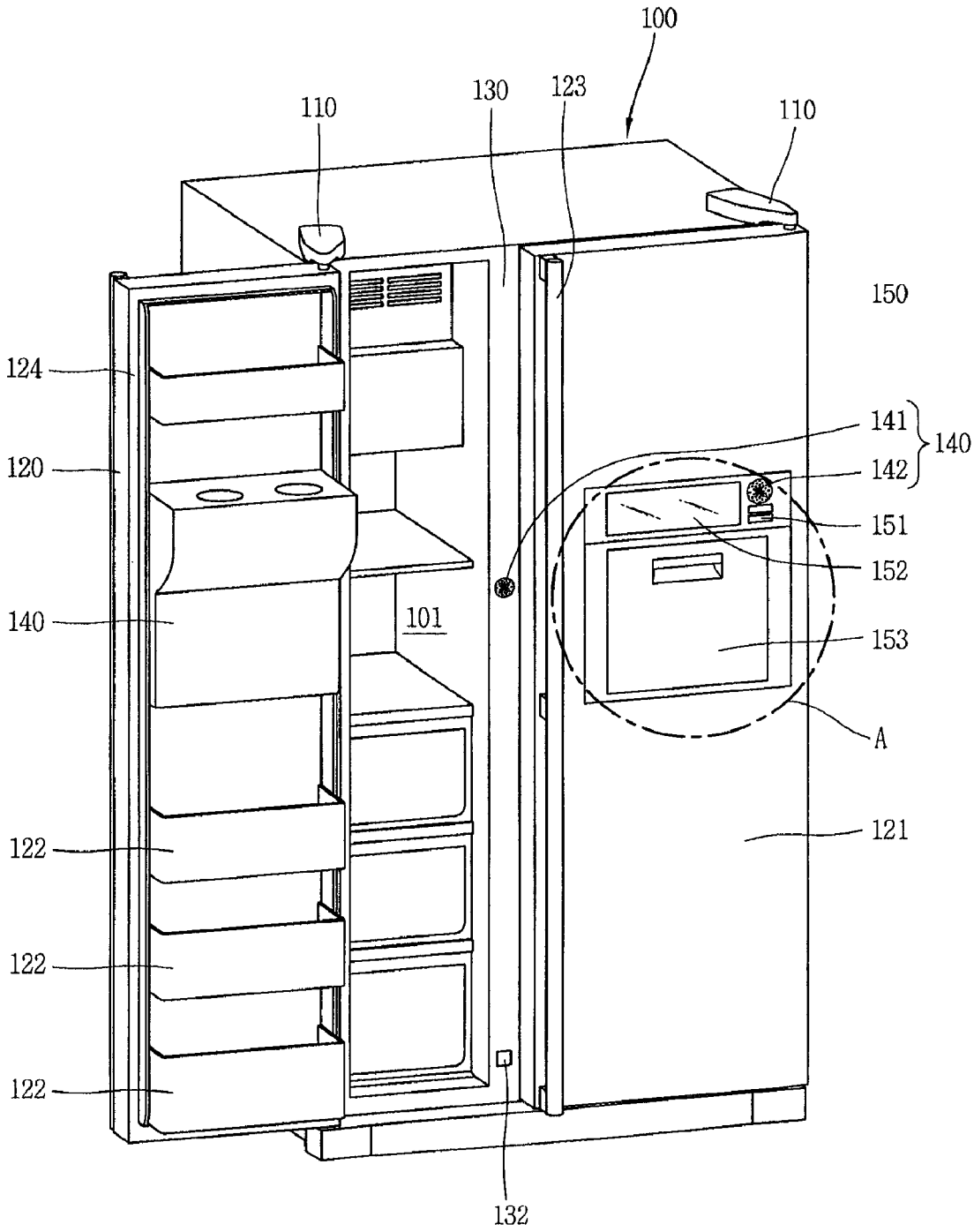
FIG. 2 is a view showing a state that one door of a refrigerator in accordance with a first embodiment of the present invention is opened.

FIG. 2 is a view showing a state that one door of the refrigerator in accordance with a first embodiment of the present invention is opened. And, FIG. 3 is a view showing an interior of the refrigerator in FIG. 2.

Figure 3:
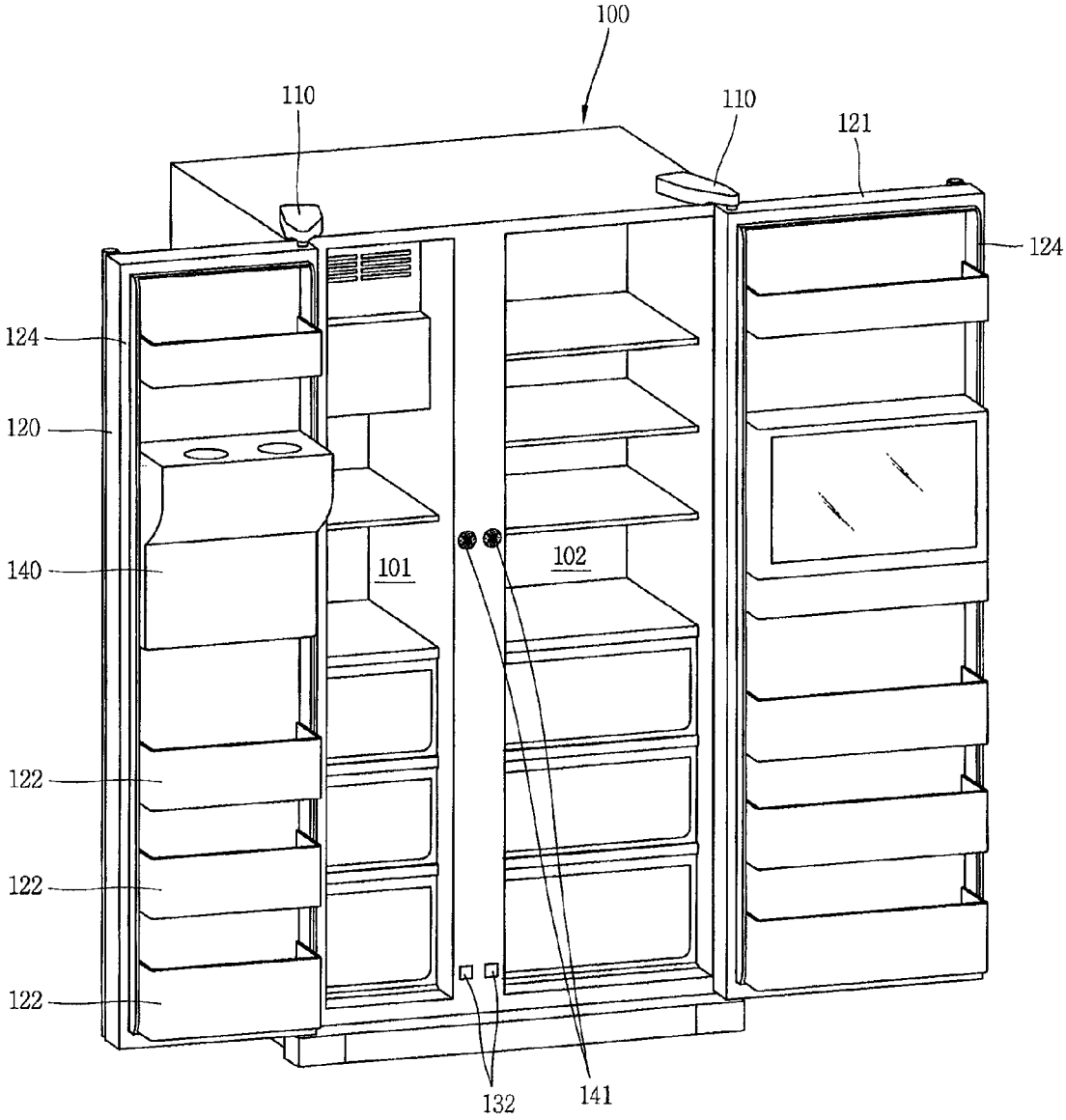
FIG. 3 is a view showing an interior of the refrigerator in FIG. 2.

Referring to FIGS. 2 and 3, the refrigerator in accordance with the first embodiment includes a main body, a voice input section, a control unit and an output section.

First, the main body will be explained.

The refrigerator 100 in accordance with the first embodiment of the present invention is provided with a storage space having an opening at one side thereof, and includes a main body including a door by which the opening is opened or closed.

The storage space in this embodiment is partitioned into right and left spaces by a partition wall 130.

The left space partitioned by the partition wall 130 is implemented as a freezing chamber 101 for storing storage items in a frozen manner, and the right space is implemented as a cooling chamber 102 for storing the storage items in a chilling manner.

And, the freezing chamber 101 and the cooling chamber 102 are selectively closed by a freezing chamber door 120 and a cooling chamber door 121, respectively.

Here, the freezing chamber door 120 and the cooling chamber door 121 are pivotably mounted by hinges 110. And, the freezing chamber door 120 and the cooling chamber door 121 are each further provided with door handles 123 at the front surfaces thereof, and thus the user can pivotably open or close the freezing chamber door 120 or the cooling chamber door 121 by grasping the door handles 123.

A plurality of door baskets 122 are provided at a rear surface of the freezing chamber door 120 and the cooling chamber door 121, for receiving the storage items therein. Particularly, a dispenser 140 is further provided at the rear surface of the freezing chamber door 120, for taking out ice or water from the outside thereof without opening the freezing chamber door 120.

Further, a home bar 153 is provided at the cooling chamber door 121, for taking out beverages or items stored therein from the outside without opening the cooling chamber door 121.

The home bar 153 is provided with a home bar door selectively opened or closed at a portion partially cut out at the cooling chamber door 121, and a storage space communicated with the cooling chamber 102 at the rear surface of the home bar door.

Accordingly, the user can take out the beverages or items stored in the storage space by opening the home bar door without opening the cooling chamber door 121.

Next, the voice input section will be explained in detail.

The voice input section 140 of the refrigerator in accordance with this embodiment includes an interior voice input unit 141 installed at an inside of the main body and an exterior voice input unit 142 installed at an outside of the main body.

Accordingly, a user can input his/her own speech to the refrigerator regardless of whether the cooling chamber door 121 or the freezing chamber door 120 is opened or closed.

The voice input section 140 is implemented as a device for converting speech into electrical signals, generally, such as a microphone.

Preferably, the exterior voice input unit 142 is installed at the front surface of the cooling chamber door 121 or the freezing chamber door 120, for easily inputting the speech.

In this embodiment, the interior voice input unit 141 is installed at an edge portion on the opened front surface of the cooling chamber 102 and the freezing chamber 101 partitioned by the partition wall 130.

Further, the interior voice input unit 141 is installed at a position that the edge portion on the opened front surface of the cooling chamber 102 and the freezing chamber 101 comes in contact with the cooling chamber door 121 and the freezing chamber door 120 when the cooling chamber door 121 and the freezing chamber door 120 are closed.

And, preferably, a gasket 124 is disposed at an edge portion on the rear surface of the cooling chamber door 121 and the freezing chamber door 120 so as to prevent cool air from being leaked from the cooling chamber 102 and the freezing chamber 101, and the interior voice input unit 141 is installed at a position covered by the gasket 124 when the cooling chamber door 121 and the freezing chamber door 120 are closed.

Meanwhile, preferably, the interior voice input unit 141 and the exterior voice input unit 142 are each installed to be operable according to whether the cooling chamber door 121 or the freezing chamber door 120 is opened or closed.

Thus, an open and close sensing unit 132 sensing whether the cooling chamber door 121 or the freezing chamber door 120 is opened or closed is provided.

The open and close sensing unit 132 includes a permanent magnet provided at one edge portion on the rear surface of the cooling chamber door 121 or the freezing chamber door 120, and a magnetic sensing circuit provided at one edge portion on the opened front surface of the cooling chamber 102 or the freezing chamber 101. The permanent magnet and the magnet sensing circuit contact with each other when the cooling chamber door 121 or the freezing chamber door 120 is closed.

Installation locations for the permanent magnet and the magnetic sensing circuit are not limited thereto, and vice versa.

Meanwhile, when the open and close sensing unit 132 senses that the cooling chamber door 121 or the freezing chamber door 120 is open, the interior voice input unit 141 is controlled to operate, while on the contrary, when sensing that the cooling chamber door 121 or the freezing chamber door 120 is closed, the exterior voice input unit 142 is controlled to operate.

Alternately, selection buttons 151 may be provided on the front surface of the cooling chamber door 121 or the freezing chamber door 120 so that the user can select the voice input section 140 to be operated according to whether or not the cooling chamber door 121 or the freezing chamber door 120 is opened or closed.

Next, the output section will be explained with reference to FIG. 4.

Figure 4:
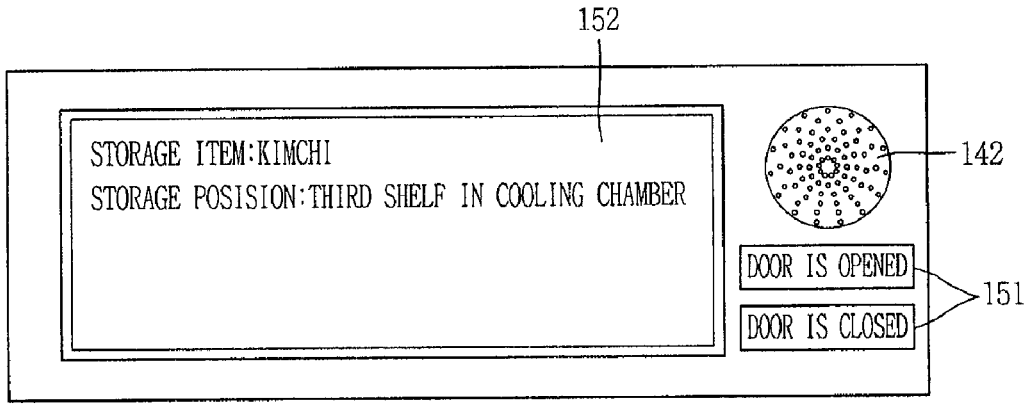
FIG. 4 is an enlarged view showing an output unit (A) in FIG. 2.

FIG. 4 is an enlarged view of the output section (A) in FIG. 2.

Referring to FIG. 4, the output section 152 is operable for enabling the user to check the state information of the refrigerator, that is, the state and the result of controlling by a control command inputted through the voice input section 140, from the outside thereof.

In this embodiment, the output section 152 is implemented as a video display terminal such as an LCD, etc. And, the exterior voice input unit 142 and the selection buttons 151 by which the door is selected to opened or closed may be provided at the periphery of the output section.

The output section 152 displays the state information of the refrigerator by characters. FIG. 4 is one exemplary view showing the output section on which information about the storage items, such as the kind thereof, the storage position, etc. is displayed.

Furthermore, information such as optimum positions where a storage item is to be stored, the storage position of an item of the same kind, etc. may be displayed on the output section 152.

Next, the control unit and the operation of the refrigerator in accordance with the first embodiment of the present invention will be explained with reference to FIG. 5.

Figure 5:
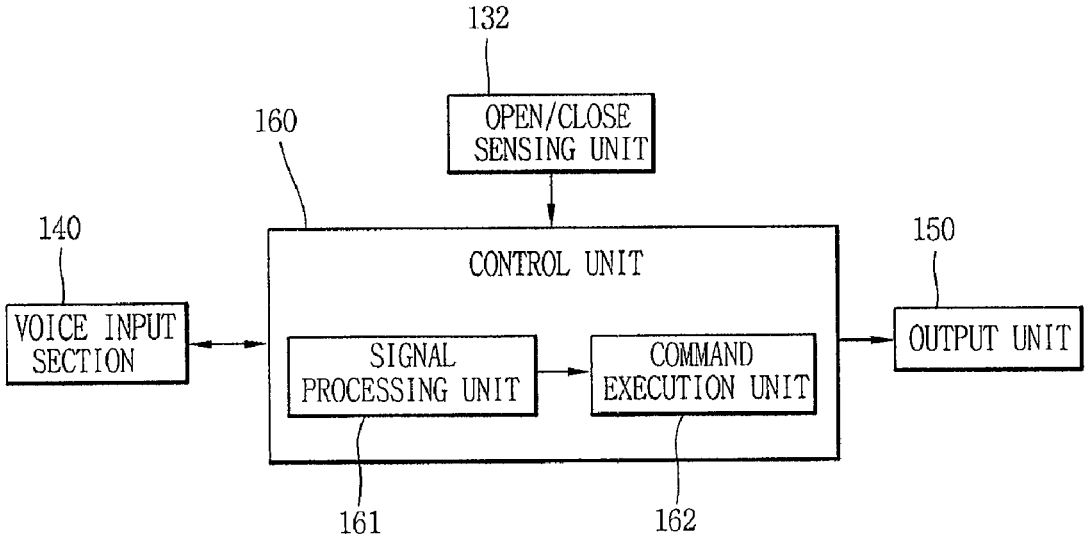
FIG. 5 is a block diagram showing the configuration of a control system of the refrigerator in accordance with the first embodiment of the present invention.

FIG. 5 is a block diagram showing the configuration of the control system of the refrigerator in accordance with the first embodiment of the present invention.

Referring to FIG. 5, the control unit 160 in accordance with this embodiment includes a signal processing unit 161 converting speech input to the voice input section 140 into a control command code by analyzing the speech and a command execution unit 162 executing the command by a corresponding control command code resulting from comparing the converted control command code with a pre-stored control command code.

Accordingly, the control unit 160 controls the state of the refrigerator by analyzing the inputted speech and displays the result of the controlling to the outside through the output section 152.

Hereafter, the operation of the refrigerator in accordance with the first embodiment of the present invention will be explained.

It will be explained as one example that the name of a storage item is information inputted to the voice input section 140, and the name of the storage item, the storage position of the item, the storage position of an item of the same kind, and an optimum position where the storage item is to be stored are outputted through the output section 152.

The speech inputted from the outside is converted into electrical signals by the voice input section 140 and then transferred to the signal processing unit 161 of the control unit 160.

The signal processing unit 161 converts the transferred electrical speech signals into a control command code through a frequency analysis, etc. and then transfers the code to the command execution unit 162 of the control unit 160.

The command execution unit 162 selects the corresponding control command code by comparing the converted control command code with pre-stored control command codes.

Accordingly, it is commanded that the state or operation of the refrigerator is controlled by the corresponding control command code. And, the result is displayed to the outside through the output section 152.

Thus, if the user inputs the name of a storage item to be stored in the refrigerator with his/her own voice, the name of the storage item and the storage position of the item can be displayed through the signal processing unit 161 and the command execution unit 162.

In addition, it is capable of displaying the name of the storage item and the storage position the item of the same kind, which is inputted to the output section 152 by manipulation of the command execution unit 162, or of displaying the inputted name of the storage item and the optimum position where the storage item is to be stored.

Meanwhile, in this embodiment, the speech input from the outside may be adjusted to be inputted into the exterior voice input unit 142 or the interior voice input unit 141 according to whether the cooling chamber door 121 or the freezing chamber door 120 is opened or closed.

That is, when the open and close sensing unit 132 senses that the cooling chamber door 121 or the freezing chamber door 120 is open, the interior voice input unit 141 is controlled to operate. Here, the operation of the exterior voice input unit 142 is stopped, thereby preventing power from being wasted.

On the contrary, when the open and close sensing unit 132 senses that the cooling chamber door 121 and the freezing chamber door 120 are closed, the exterior voice input unit 142 is controlled to operate. Here, the operation of the interior voice input unit 141 is stopped.

Hereinafter, the refrigerator in accordance with the second embodiment of the present invention will be explained in detail with reference to the accompanying drawings. The refrigerator according to the second embodiment of the present invention has the same effects and configurations as the first refrigerator, and thus its detailed explanation will be omitted.

Figure 6:
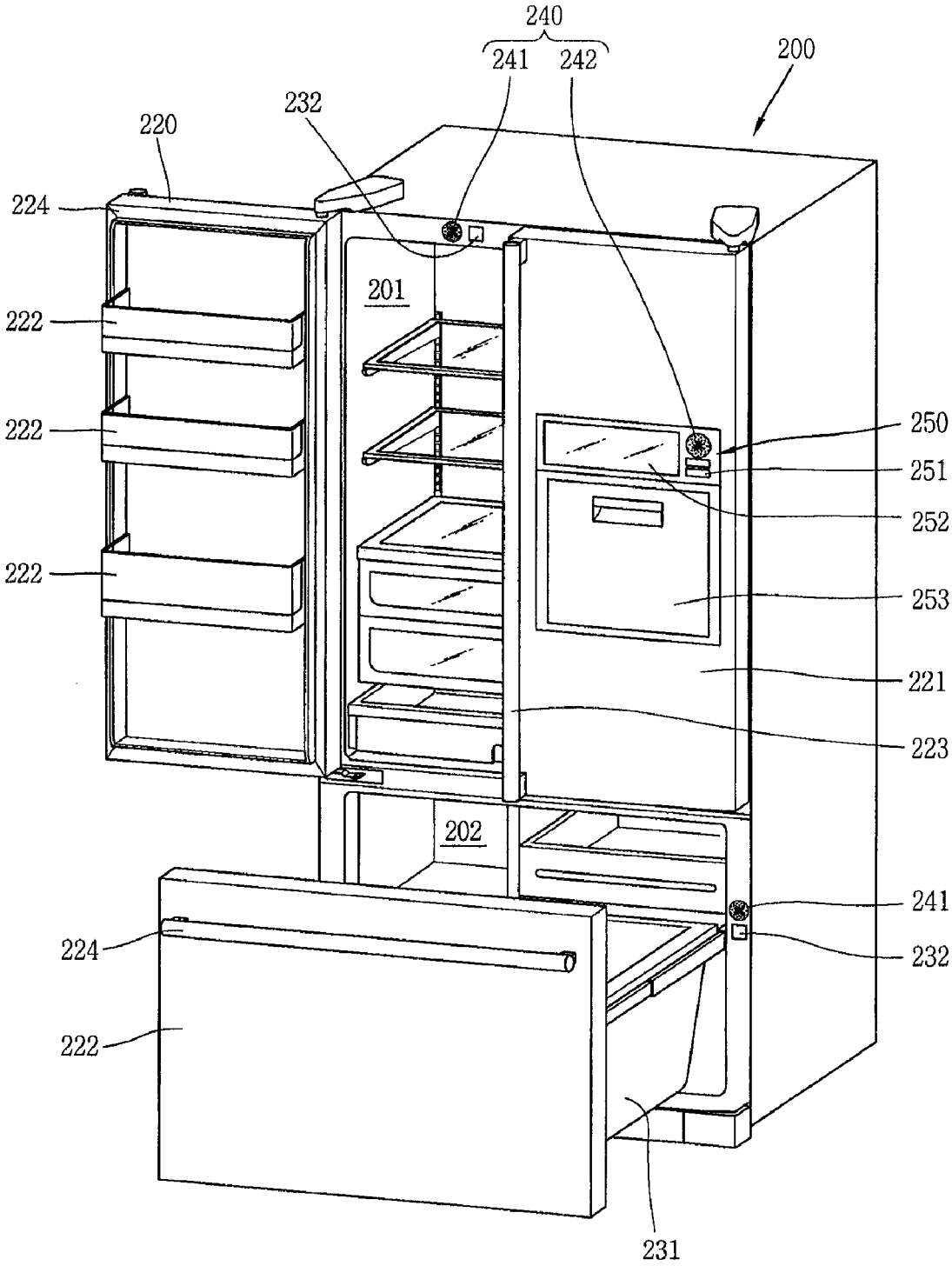
FIG. 6 is a view showing a state that one door of a refrigerator in accordance with a second embodiment of the present invention is opened.
Figure 7:
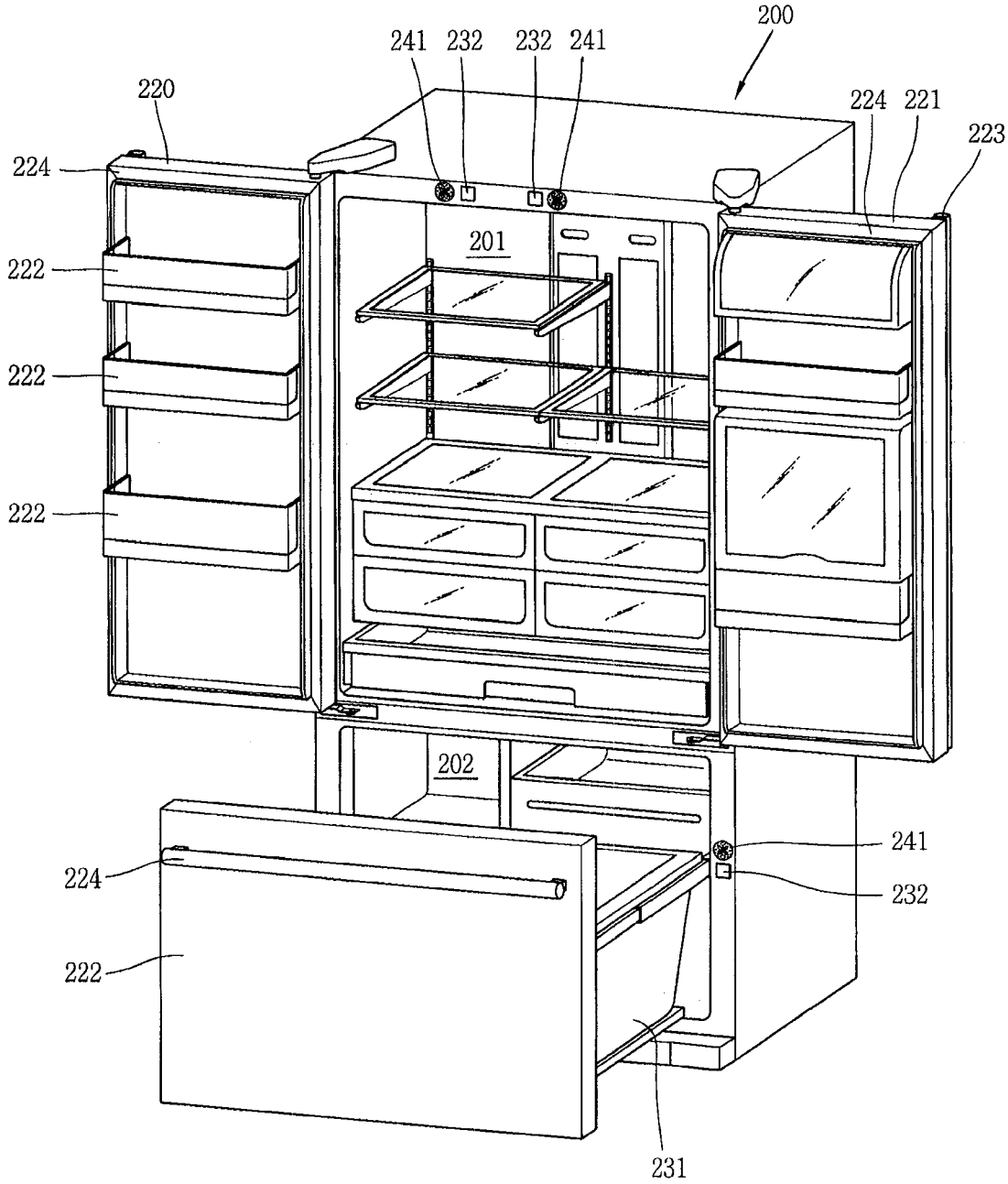
FIG. 7 is a view showing an interior of the refrigerator in FIG. 6.

FIG. 6 is a view showing a state that one door of the refrigerator in accordance with the second embodiment of the present invention is opened, and FIG. 7 is a view showing an interior of the refrigerator of FIG. 6.

Referring to FIGS. 6 and 7, the refrigerator in accordance with this embodiment includes a plurality of cooling chamber doors 220 or freezing chamber doors 222 by which an opening formed in a cooling chamber 201 or a freezing chamber 202 is opened/closed.

Thus, if some of the plurality of cooling chamber doors 220 or freezing chamber doors 222 are opened/closed, but not all of them, an external speech input may not be received by the refrigerator.

To prevent the abovementioned problem, in this embodiment, an interior voice input unit 241 is installed at each edge portion on the openings of the storage spaces contacted by the plurality of cooling chamber doors 220 or freezing chamber doors 222, respectively.

Accordingly, the refrigerator is capable of sensing whether or not the plurality of cooling chamber doors 220 or the freezing chamber doors 222 are opened/closed, respectively, thereby being capable of preventing the external speech input from not being received.

Hereafter, the refrigerator in accordance with a third embodiment of the present invention will be explained in detail with reference to the accompanying drawing. The refrigerator according to the third embodiment of the present invention has the same effects and configurations as the first refrigerator, and thus its detailed explanation will be omitted.

Figure 8:
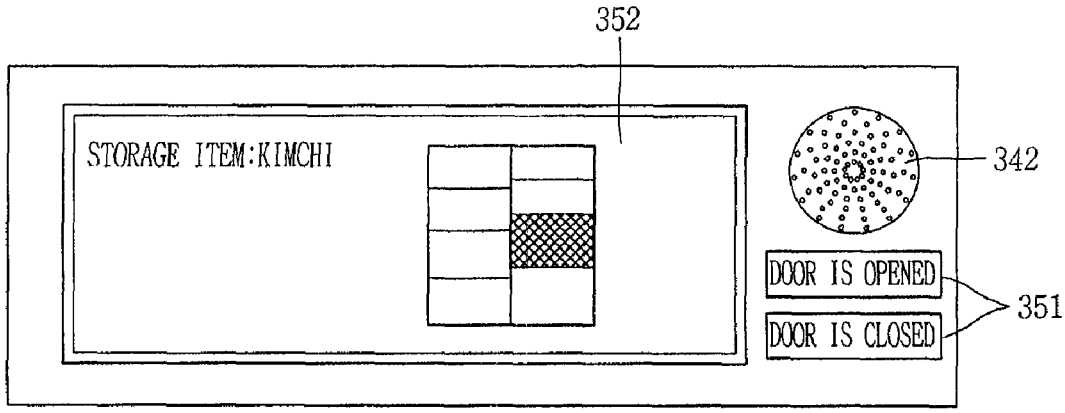
FIG. 8 is a view showing an output unit of a refrigerator in accordance with a third embodiment of the present invention.

FIG. 8 is a view showing an output section of the refrigerator in accordance with the third embodiment of the present invention.

Referring to FIG. 8, the output section 352 in accordance with this embodiment is implemented as a video display terminal such as an LCD, etc., and selection buttons 351 by which an exterior voice input unit 342 and doors are selected to be opened or closed may be provided at the periphery of the output section.

Here, the output section 352 displays the state information of the refrigerator by characters and figures.

That is, the output section 352 displays the name of a storage item by characters, and displays the storage position of the item, the optimum position where the storage item is to be stored or the storage position of an item of the same kind, etc. by indicating the storage spaces of the refrigerator as a figure.

Thus, since various information is displayed by one figure, the amount of processed data is reduced, thereby quickly obtaining a reaction with respect to the inputting of the speech.

Hereafter, the refrigerator in accordance a fourth embodiment of the present invention will be explained in detail with reference to the accompanying drawing. The refrigerator according to the fourth embodiment of the present invention has the same effects and configurations as the first refrigerator, and thus its detailed explanation will be omitted.

Figure 9:
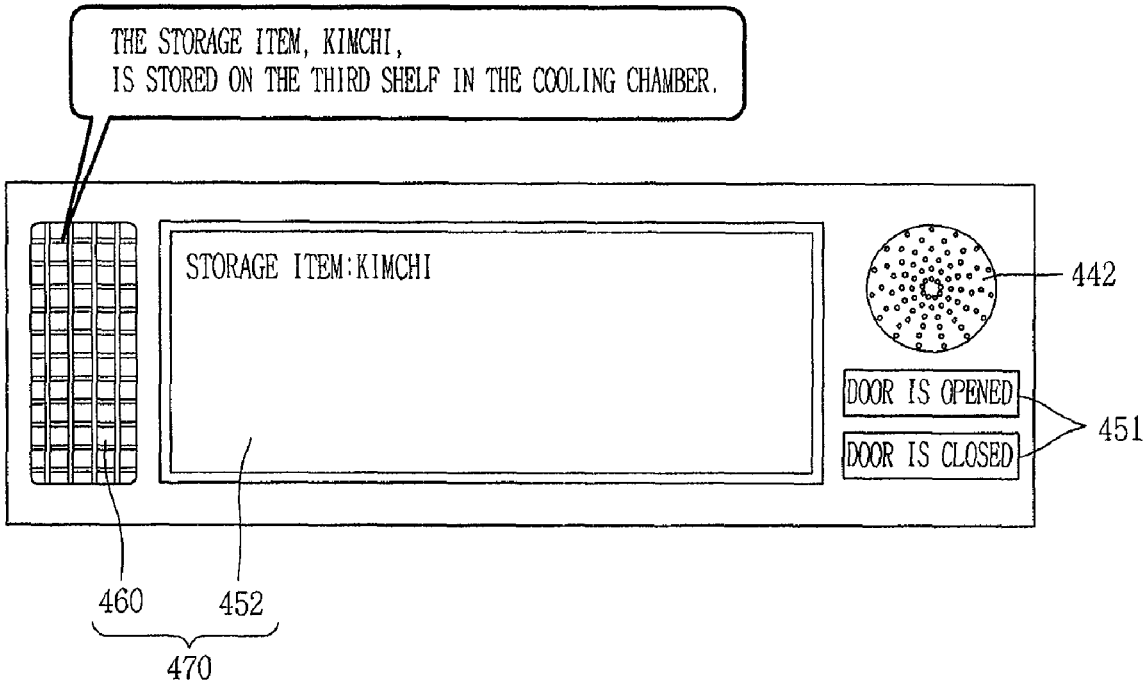
FIG. 9 is a view showing an output unit of a refrigerator in accordance with a fourth embodiment of the present invention.

FIG. 9 is a diagram showing an output section of the refrigerator in accordance with the fourth embodiment of the present invention.

Referring to FIG. 9, the output section 470 in accordance with this embodiment is further provided with a speech output device 460 implemented as a speaker, etc. as well as a video display terminal 452 implemented as an LCD, etc.

The output section 470 may also be implemented only as the speech output device 460 without the video display terminal 452.

In addition, selection buttons 451 by which an exterior voice input unit 442 and the doors are selected to be opened or closed may be provided at the periphery of the output section 470.

The speech output device 460 outputs the name of the storage item and the storage position of the item, the optimum position where the storage item is to be stored or the storage position of an item of the same kind by speech with respect to the storage item information by speech input received from the outside.

Thus, the user can obtain necessary information without checking the video display terminal 452, and visually handicapped users or elderly people who are not familiar with the video display terminal 452 can conveniently use the refrigerator.

The refrigerator according to the present invention has the following advantages.

First, since the state and operation of the refrigerator are controlled by receiving control commands by speech, it is capable of reducing a user's inconvenience due to manipulating the control panel.

Second, since a voice input unit is respectively provided at each of the inside and the outside of the refrigerator main body, it is capable of receiving a control command input by speech regardless of whether the doors are opened or closed, thereby providing convenience to the user.

Third, since each voice input unit respectively provided at the inside and the outside of the refrigerator main body is made to operate according to whether the doors are opened or closed, it is capable of reducing power wasted by the voice input.

Fourth, since it facilitates to check the kind of the storage item and the storage position of the item by speech input, a user's satisfaction can be increased.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A refrigerator, comprising:

a main body having a storage space provided with an opening, and a door by which the opening is opened or closed;

a voice input section for receiving voice input from a user through an interior voice input unit installed at an inside of the main body and an exterior voice input unit installed at an outside of the main body;

a control unit controlling a state of the refrigerator by analyzing the voice input; and an output section outputting state information so as to enable checking of the state information from outside the refrigerator, wherein the interior voice input unit is installed at one edge portion of the opening contacted by the door when the door is closed.

2. The refrigerator of claim 1, wherein the voice input section is configured to be capable of receiving an external voice input regardless of whether the door is opened or closed.

3. The refrigerator of claim 1, wherein the interior voice input unit is installed to be covered by a gasket provided at an edge portion of a rear surface of the door when the door is closed.

4. The refrigerator of claim 1,wherein the storage space is partitioned into a plurality of storage spaces by at least a partition wall, wherein a plurality of doors are provided to open or close openings of the storage spaces, respectively, and wherein each of the interior voice input units is installed at an edge portion on each of the openings of the storage spaces contacted by each door when the corresponding door is closed.

5. The refrigerator of claim 1, wherein the storage space is partitioned into a plurality of storage spaces by a partition wall, and wherein at least one interior voice input unit is installed at one edge portion of the opening of each storage space.

6. The refrigerator of claim 1, wherein the exterior voice input unit is installed at a front surface of the door.

7. The refrigerator of claim 1, wherein the interior voice input unit and the exterior voice input unit are made operable, respectively, according to whether the door is opened or closed.

8. The refrigerator of claim 1, wherein selection buttons are further provided at one side of the main body by which the exterior voice input unit or the interior voice input unit is selected to operate or not according to whether the door is opened or closed.

9. The refrigerator of claim 1, further comprising an open and close sensing unit for sensing whether the door is opened or closed, and wherein the exterior voice input unit is operated when the door is closed and the interior voice input unit is operated when the door is opened, by the open and close sensing unit.

10. The refrigerator of claim 9, wherein the open and close sensing unit includes a permanent magnet installed at one side of one edge portion on a rear surface of the door and one edge portion of the opening of the storage space, which contact with each other when the door is closed, and a magnetic sensing circuit installed at the other side thereof.

11. The refrigerator of claim 1, wherein the control unit comprises:

a signal processing unit converting speech input to the voice input unit into a control command code by analyzing the speech; and a command execution unit executing a command corresponding to a control command code resulting from comparing the converted control command code with a pre-stored control command code.

12. The refrigerator of claim 1, wherein the output section is implemented as a video display terminal for visually outputting the state information.

13. The refrigerator of claim 1, wherein the output section is implemented as a speech output device for aurally outputting the state information.

14. The refrigerator of claim 1, wherein the voice input unit is configured to receive information about a storage item to be stored in the storage space, wherein the control unit is configured to analyze the information about the storage item so as to memorize and determine the information, and wherein the output section is configured to output the information about the storage item and a result of the determination.

15. The refrigerator of claim 14, wherein the storage item information inputted via the voice input unit includes a name of the storage item and a storage position of the item.

16. The refrigerator of claim 14, wherein the output section is configured to output the name of the storage item, the storage position of the item, a storage position of an item of the same kind and an optimum position where the storage item is to be stored.

* * * * *